US006880747B1

(12) United States Patent
Pelleg

(10) Patent No.: US 6,880,747 B1
(45) Date of Patent: Apr. 19, 2005

(54) DOCUMENT CASE WITH EXPANDING AND FIXED SECTIONS

(75) Inventor: Roni Pelleg, Woodland Hills, CA (US)

(73) Assignee: Better Office Products, Inc., Canoga Park, CA (US)

( * ) Notice: Subject to any disclaimer, the term of this patent is extended or adjusted under 35 U.S.C. 154(b) by 17 days.

(21) Appl. No.: 10/382,794

(22) Filed: Mar. 5, 2003

Related U.S. Application Data

(60) Provisional application No. 60/362,118, filed on Mar. 5, 2002.

(51) Int. Cl.[7] ..... B65D 27/00
(52) U.S. Cl. ..... 229/67.3; 206/425; 229/67.4
(58) Field of Search ..... 206/425; 229/67.1, 229/67.3–67.4, 72

(56) References Cited

U.S. PATENT DOCUMENTS 766,724 A * 8/1904 Noble ..... 229/72
1,381,793 A * 6/1921 Caine ..... 229/72
4,790,474 A * 12/1988 Mitsuyama ..... 229/67.3
5,271,502 A 12/1993 Chang
5,630,509 A 5/1997 Su
5,664,724 A * 9/1997 Ho ..... 229/67.4
5,806,754 A * 9/1998 Boyle ..... 229/72
6,047,879 A * 4/2000 Henrikson et al. ..... 229/67.3
6,607,122 B1 * 8/2003 Ong ..... 229/67.3
2003/0029762 A1 * 2/2003 Ho ..... 206/425

* cited by examiner

*Primary Examiner*—Bryon P. Gehman
(74) *Attorney, Agent, or Firm*—Blakely, Sokoloff, Taylor & Zafman LLP

(57) ABSTRACT

A document case comprising a back panel, a fixed pocket, and an expandable file. The expandable file has two opposing accordion-pleated sides and an accordion-pleated bottom. The expandable file joins the back panel to the fixed pocket. A closure flap extends from the back panel to close the document case by extending over the first expandable file and the fixed pocket.

14 Claims, 4 Drawing Sheets

DOCUMENT CASE WITH EXPANDING AND FIXED SECTIONS

CROSS REFERENCE TO RELATED APPLICATIONS

This application claims the benefit of U.S. Provisional Application No. 60/362,118, filed Mar. 5, 2002.

FIELD OF INVENTION

The present invention relates to a container for organizing paperwork and the like, and more particularly to a system comprising fixed and expandable file storage sections.

BACKGROUND OF THE INVENTION

In many instances it is desirable to carry objects, such as thick documents, that do not fit in relatively narrow expandable file pockets along with items that do. Sometimes objects that do not fit are jammed in anyway, causing deformation of the case and tearing of pockets. Another characteristic of expandable files is that they will be able to stand upright in some instances but not others. This is often dependent on how full the expandable files are, the location of documents in the pockets or how far the user expands the file. It is desirable to widen the range of circumstances under which a file case will stand on its own and to increase the ease with which a user may cause the document case to stand.

SUMMARY OF THE INVENTION

Briefly stated, in accordance with the present invention, there is provided a system comprising a document case including expandable files and a fixed pocket file pocket.

BRIEF DESCRIPTION OF THE DRAWINGS

The invention, both as to its organization and manner of operation may be further understood by reference to the following drawings taken in connection with the following description.

Of the drawings.

DETAILED DESCRIPTION OF THE INVENTION

Figure 1:
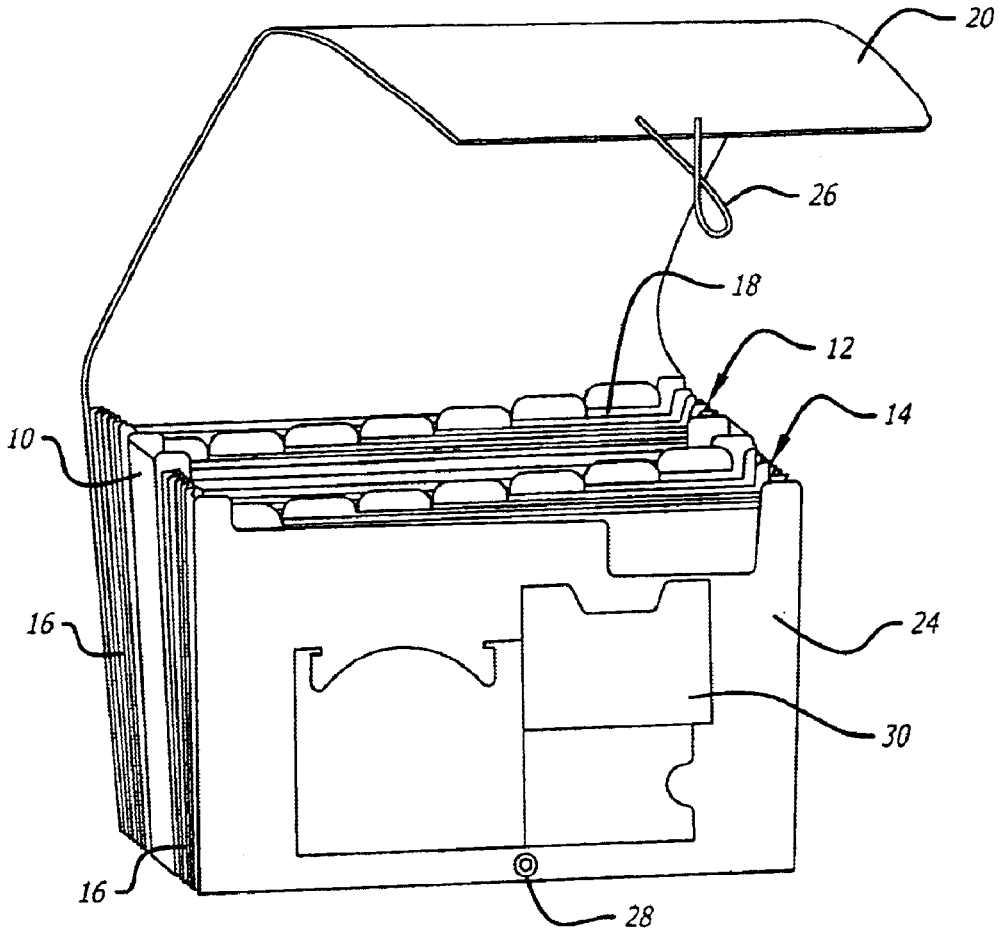
FIG. 1 is a perspective view of a system constructed in accordance with the present invention.
Figure 2:
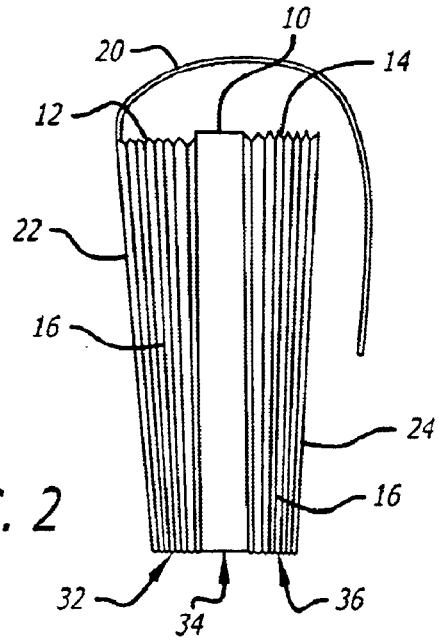
FIG. 2 is a side view of the embodiment of FIG. 1.

FIGS. 1 and 2 are respectively a perspective view and side elevation of a first embodiment of the present invention. A central fixed pocket 10 is surrounded by first expandable file

12 and second expandable file 14 portions. The central fixed pocket 10 may carry objects, such as thick documents. The expandable file portions comprise accordion-pleated sidewalls 16 and pockets 18 defined by parallel sheets extending between the sidewalls. In one embodiment, the central fixed pocket 10 may be one inch wide. A closure flap 20 extends from a back panel 22, extends over the fixed 10 and expandable 12,14 file sections and covers a front panel 24 to close the document case. An elastic loop 26 secured adjacent an end of the closure flap 20 may engage a post 28 fixed to the front panel 24 to maintain the flap in a closed position. As may be seen in FIG. 2, the first expandable file 12 has an accordion-pleated bottom 32 while the second expandable file 14 has a closed bottom 36. Thus the first expandable file 12 may be extended substantially but the second expandable file 14 is constrained and, in cooperation with the bottom panel 34 of the fixed pocket 10, provides a stable base on which the document case may stand.

The front panel 24 may have secured thereto a pocket assembly 30 preferably comprising a clear plastic panel having seams secured to the front panel to define pockets. The pocket assembly panel 30 may be cut into shape and have seams disposed to accommodate insertion of various items in the pockets. The embodiment of FIGS. 1 and 2 accommodates, for example, business cards, compact discs and computer diskettes. The pocket receiving compact discs may be dimensioned to receive either a plastic jewel case or a cardboard sleeve holding a compact disk. In the embodiment of FIGS. 1 and 2, the first expandable file 12 is adjacent the back panel and the second expandable file 14 is adjacent the front panel. Each of the expandable files has the same vertical height. These files may each, for example, accommodate letter-sized items.

Figure 3:
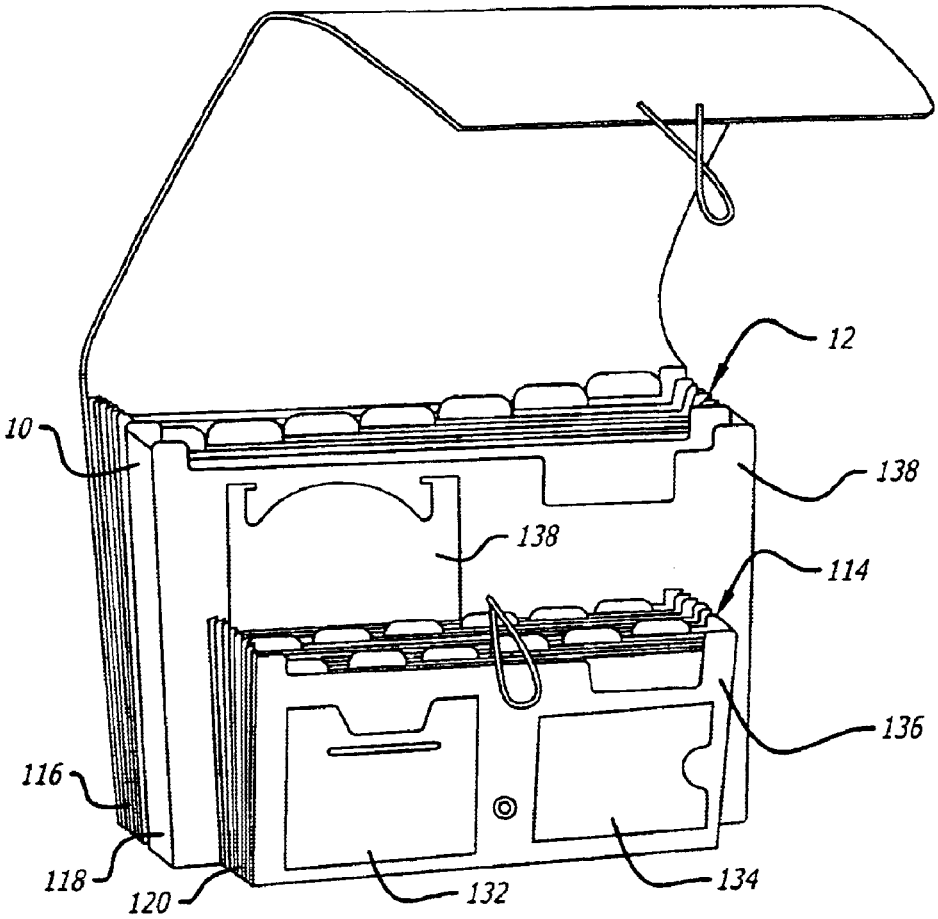
FIG. 3 is a perspective view of another embodiment of a system constructed in accordance with the present invention.
Figure 4:
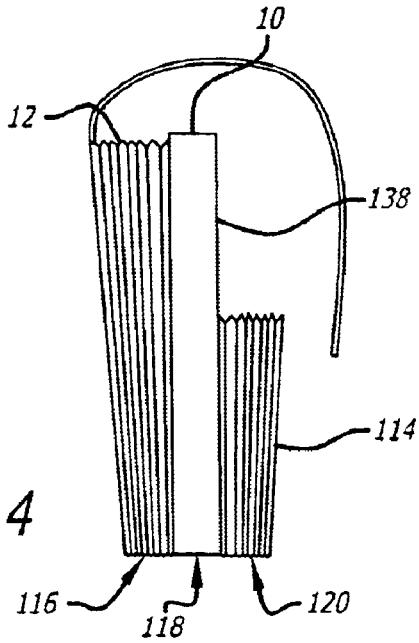
FIG. 4 is a side view of the embodiment of FIG. 3.

In the embodiments of FIGS. 3 and 4, the front expandable file 114 has a smaller dimension in both height and width than that of the rear expandable file 12. In one preferred form, the bottoms 116,120 of each expandable file are substantially coplanar with a bottom surface 118 of the fixed file pocket 10. This assists in maintaining the document case in standing. As may be seen in FIG. 4, the rear expandable file 12 has an accordion-pleated bottom 116 while the front expandable file 114 has a closed bottom 120 which, in cooperation with the bottom panel 118 of the fixed pocket 10, further assists the document case in standing. As seen in FIG. 3, the pocket assembly 130,132,134 is distributed rather than unitary. Portions of the pocket assembly are formed on a front surface 136 of the front expandable file 114. In the embodiment as illustrated, the pocket adapted for holding a CD is fixed to an uncovered front portion 138 of the fixed width, central document holder 10.

Figure 5:
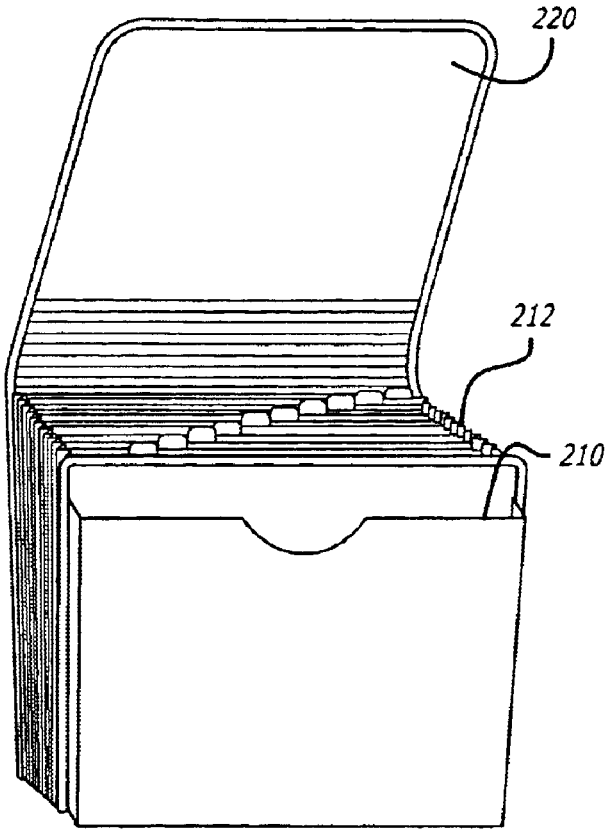
FIG. 5 is a perspective view of a further embodiment a of system constructed in accordance with the present invention.
Figure 6:
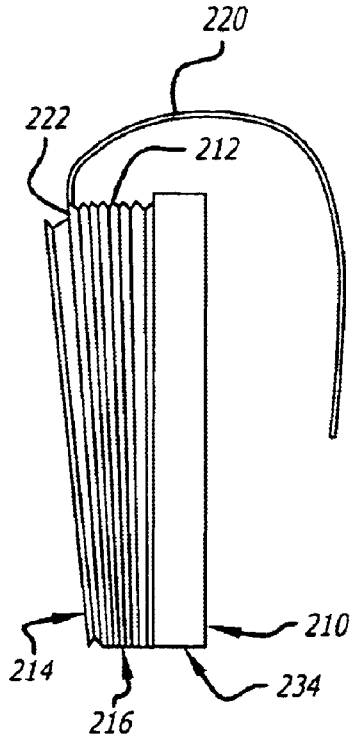
FIG. 6 is a side view of the embodiment of FIG. 5.
Figure 7:
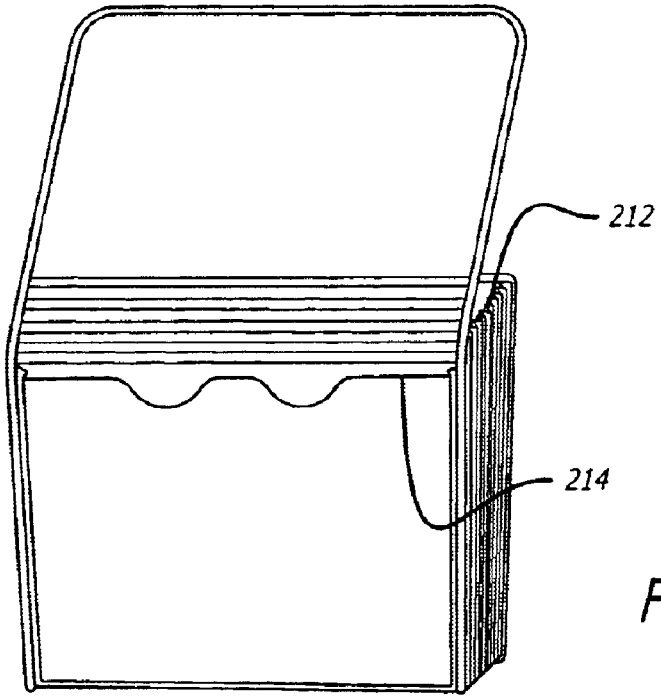
FIG. 7 is a rear perspective view of the embodiment of FIG. 5.
Figure 8:
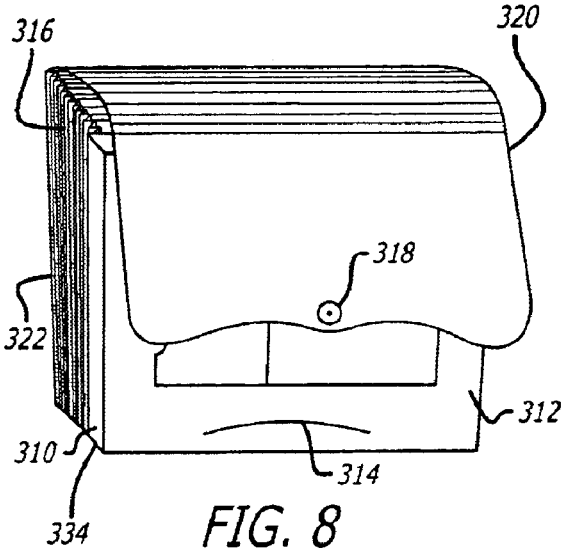
FIGS. 8 and 9 are a perspective view of an alternate form of the embodiment of FIG. 5 illustrating a closure flap in a raised and lowered position respectively.
Figure 9:
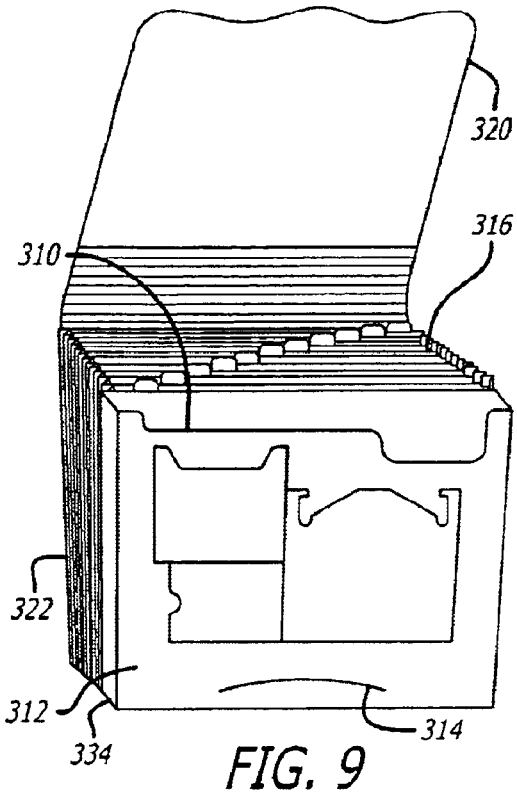
Figure 10:
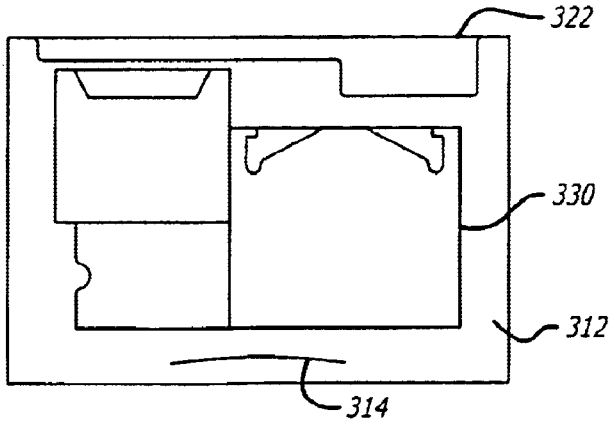
FIG. 10 is an elevation of a front panel of the embodiment of FIGS. 8 and 9.
Figure 11:
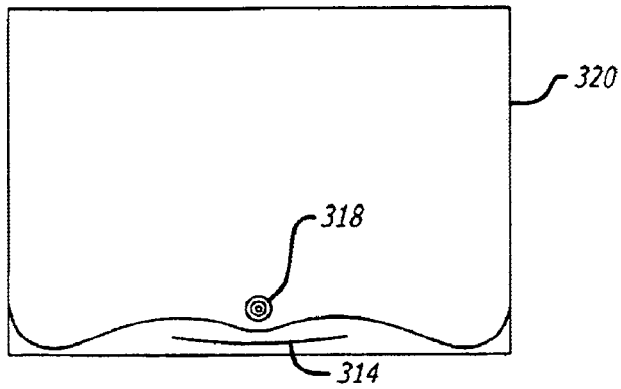
FIG. 11 is an elevation of a closure flap over the front panel of FIG. 10.

The embodiment of FIGS. 5, 6 and 7 also includes a fixed section 210 and two expandable sections 212,214. However, both expandable sections are fixed to the back panel 222, i.e. the panel from which the closure flap 224 extends. In the embodiment illustrated, a first expandable file 212 extending forwardly from the back panel 222 is located between the back panel and the fixed document holder 210. A second expandable file 214 comprises a single pocket extending rearwardly from the back panel 222. The second expandable file 214 may have a small capacity, such as a pocket having a one quarter inch gusset. However, a second expandable file of greater width could be affixed. In this case, means for securing the second expandable file 214 in a compressed disposition would be provided. As may be seen in FIG. 6, the first expandable file 212 has an accordion-pleated bottom 216. The bottom panel 234 of the fixed document holder 210 provides a stable base on which the document case may stand.

FIGS. 8–11 illustrate a further embodiment of the document case with an expanding section 316 and a fixed section 310. In this embodiment, an elastic loop 314 is fixed to a bottom portion of a front panel 312 of the fixed section 310. A post 318 to which the elastic loop 314 may be secured is fixed adjacent an end of a closure flap 320. While in the embodiment of FIG. 1, the closure flap 20 has essentially a straight line shape at its extreme end, in the present embodiment, the end of the closure flap 320 is contoured and permits ready access by fingers to the elastic loop 314. As in the embodiment shown in FIGS. 5 through 7, the first expanding section 316 has an accordion-pleated bottom and the bottom panel 334 of the fixed document holder 310 provides a stable base on which the document case may stand.

Efficient use may be made of the front panel 312 of the fixed section 310 by securing thereto a pocket assembly 330 preferably comprising a clear plastic panel having seams secured to the front panel to define pockets. The pocket assembly panel 330 may be cut into shape and have seams disposed to accommodate insertion of various items in the pockets. Efficient use of a back panel 322 on the expandable file 316 may be made for supporting the closure flap 320.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A document case comprising:

a back panel;

a fixed pocket having a rear panel and an opposing forward panel held in a spaced apart relationship by a bottom panel;

a first expandable file having a rear surface formed by the back panel and an opposing front surface formed by the rear panel of the fixed pocket, the front and rear surfaces joined by two opposing accordion-pleated sides and an accordion-pleated bottom;

a second expandable file having a rear surface formed by the forward panel of the fixed pocket and an opposing front panel, the front panel and rear surface joined by two opposing accordion-pleated sides and a closed bottom; and a closure flap that extends from the back panel, to close the document case by extending over the first expandable file and the fixed pocket.

2. The document case of claim 1, further comprising a pocket assembly coupled to the forward panel of the fixed pocket.

3. The document case of claim 1, further comprising a pocket assembly coupled to the front panel of the second expandable file.

4. The document case of claim 1, wherein the second expandable file has a smaller dimension in both height and width than that of the first expandable file.

5. The document case of claim 4, further comprising a pocket assembly including pockets coupled to the forward panel of the fixed pocket and pockets coupled to the front panel of the second expandable file.

6. The document case of claim 1, further comprising a second expandable file having a front surface formed by the back panel and an opposing rear panel, the front and rear surfaces joined by two opposing accordion-pleated sides and an accordion-pleated bottom.

7. The document case of claim 1, further comprising a post and an elastic loop to cooperate and removably maintain the closure flap in a closed position.

8. A document case comprising:

a back panel;

a fixed pocket means for receiving objects, the fixed pocket means having a forward panel;

a first expandable file means for extending substantially to receive documents;

a second expandable file means for receiving documents, the second expandable file means having a rear surface formed by the forward panel of the fixed pocket and an opposing front panel, the front panel and rear surface joined by two opposing accordion-pleated sides and a closed bottom; and a closure flap means for closing the document case by extending over the first expandable file and the fixed pocket means.

9. The document case of claim 8, further comprising a pocket assembly means coupled to the forward panel of the fixed pocket means for receiving various items.

10. The document case of claim 8, further comprising a pocket assembly means coupled to the front panel of the second expandable file for accommodating insertion of various items in pockets.

11. The document case of claim 8, wherein the second expandable file means is for receiving documents having a smaller dimension in both height and width than those received by the first expandable file.

12. The document case of claim 11, further comprising a pocket assembly means coupled to the forward panel of the fixed pocket and the front panel of the second expandable file for accommodating insertion of various items in pockets.

13. The document case of claim 8, further comprising a second expandable file means for receiving documents when the closure flap means is closing the document case.

14. The document case of claim 8, further comprising a post means and an elastic loop means for removably holding the closure flap in a closed position.

* * * * *